United States Patent [19]

de la Parra M.

[11] 4,059,961

[45] Nov. 29, 1977

[54] THERMAL MOTOR OF ACTION AND REACTION FORCES

[76] Inventor: Rodolfo de la Parra M., Isabel 1a Catolica No. 1055, Mexico 13, D.F., Mexico

[21] Appl. No.: 723,007

[22] Filed: Sept. 13, 1976

[30] Foreign Application Priority Data

Dec. 10, 1975 Mexico ..... 162457

[51] Int. Cl.[2] ..... F01K 21/00

[52] U.S. Cl. ..... 60/670; 60/325; 60/682

[58] Field of Search ..... 60/325, 643, 645, 650, 60/682, 670

[56] References Cited

U.S. PATENT DOCUMENTS

| | | | |
|---|---|---|---|
| 3,264,827 | 8/1966 | Siptrott | 60/325 |
| 3,360,924 | 1/1968 | Davis | 60/325 X |

*Primary Examiner*—Allen M. Ostrager
*Attorney, Agent, or Firm*—Ladas, Parry, Von Gehr, Goldsmith & Deschamps

[57] ABSTRACT

One embodiment of the invention is made up of two closed and joined containers which are in communication through an intermediate neck; the containers remain in an upper and a lower position, the lower container being supported on legs or a support structure. The lower container has an infeed orifice for the fluid agent which serves for its operation. This fluid agent is conducted through a tube to a pump which drives the liquid through further tubing to a hollow shaft which acts as the support for a turbine of hollow ovoid construction which acts as flywheel and distributor of the fluid used for its operation, and has a plurality of peripheral nozzles for the discharge of the fluid, this turbine being located in the upper container in the presence of vapor at a pressure and temperature which maintain of the proper proportions for its operation. This turbine shaft is mounted on rotary bearings carried on supports or frames joined to the inside of the upper container; this container permits the withdrawal and installation of the hollow turbine shaft, and at the ends of the upper container there are packing glands or seals which prevent the escape of the vapor to the atmosphere of the ends, but permitting the rotation of the shaft; and this provides a power take off to which a speed reducer or any other; device can be connected to transmit the power for desired uses.

10 Claims, 4 Drawing Figures

Fig. 3.
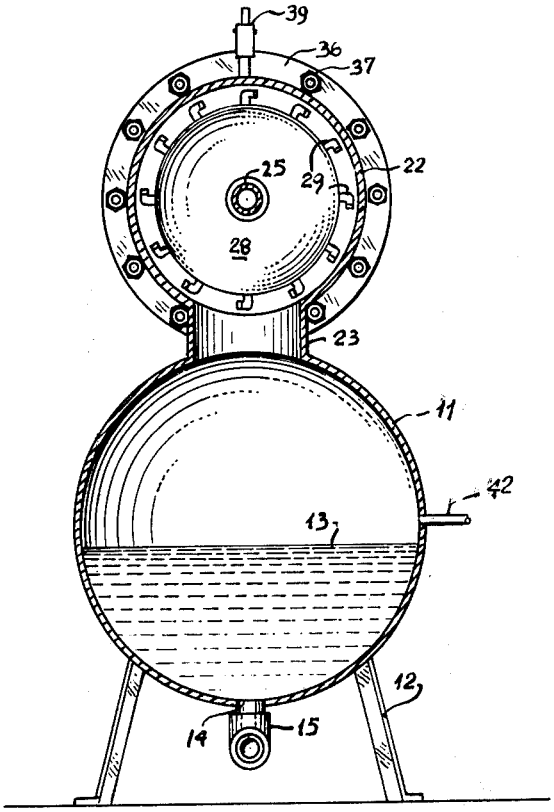
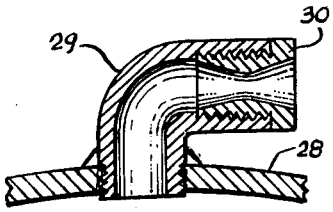
Fig. 4.

THERMAL MOTOR OF ACTION AND REACTION FORCES

BACKGROUND OF THE INVENTION

When manking began its study of nature in remote periods, the idea was conceived of a revolving ball (aeolipile) driven by the steam which escaped from elbow-shaped tubes mounted in diametrically opposed positions and making the ball turn. This invention predicted future steam machines.

It can be said that all existing steam engines are developed upon the foregoing principle, where the liberation of steam produces work but the energy losses are irrecoverable, with the result that the efficiency of steam thermal engines is very low in comparison with other types of engines.

In addition, up to the present the existing engines have not operated in a closed system with constant pressure and temperature, which would allow them the use or recovery of the energy liberated by molecular expansion, in which the discharge of the fluid agent is carried out within a closed system in which there are no losses in the process, and a high engine efficiency is accordingly obtained.

SUMMARY OF THE INVENTION

By reason of the foregoing, it is one object of this invention to provide a thermal engine driven by the discharge of a reaction turbine, to operate in an environment of a vapor in the presence of its liquid, in a closed system.

The foregoing makes manifest the possibility of being able to make use of a part of work which is spontaneously generated by the component particles of matter when they perform their movement, in obedience to existing latent forces.

The preceding all indicates that within a closed system reversible cycles or processes can be carried out, and it follows that the fluid movement can be established in a single direction; this movement can be controlled, and it furthermore is not used as such to perform outgoing work, but instead it remains within the closed system, and for this reason the energy or calorific capacity along with the matter remain within the system.

One embodiment of the invention is made up of two closed and joined containers which are in communication through an intermediate neck; the containers remain in an upper and a lower position, the lower container being supported on legs or a support structure. The lower container has an infeed orifice for the fluid agent which serves for its operation. This fluid agent is conducted through a tube to a pump which drives the liquid through further tubing to a hollow shaft which acts as the support for a turbine of hollow ovoid construction which acts as flywheel and distributor of the fluid used for its operation, and has a plurality of peripheral nozzles for the discharge of the fluid, this turbine being located in the upper container in the presence of vapor at a pressure and temperature which maintain of the proper proportions for its operation. This turbine shaft is monted on rotary bearings carried on supports or frames joined to the inside of the upper container; this container permits the withdrawal and installation of the hollow turbine shaft, and at the ends of the upper container there are packing glands or seals which prevent the escape of the vapor to the atmosphere of the ends but permitting the rotation of the shaft; and this provides a power take off to which a speed reducer or any other device can be connected to transmit the power for desired uses.

The upper container may include a part thereof which is removably attached with flanges to permit suitable mechanical installations and maintenance for the turbine and the nozzles which are installed in elbows connected to the periphery of the reaction turbine. It may also include the equipment, safety valves, thermometers and manometers and other necessary measuring apparatus, as well as a source of electrothermal energy connected below to the lower container, which replaces the heat dissipated through the walls which form the system. Likewise the equipment can be constructed in any size and shape and of conventional materials, and can be joined together and its parts connected by any means which may facilitate its working operation and mechanical maintenance.

These and other objects to be obtained in the practice of this invention will be more clearly appreciated in the reading of the following description which refers to the accompanying drawings of the preferred embodiment of the invention.

BRIEF DESCRIPTION OF THE DRAWINGS

FIG. 3 is a view in conventional cross section of the embodiment of the invention shown in FIGS. 1 and 2.

FIG. 4 is a view in lengthwise section in detail showing a part of the wall of the reaction turbine with an elbow connected thereto and in the end thereof a nozzle.

DETAILED DESCRIPTION OF THE INVENTION

Figure 1:
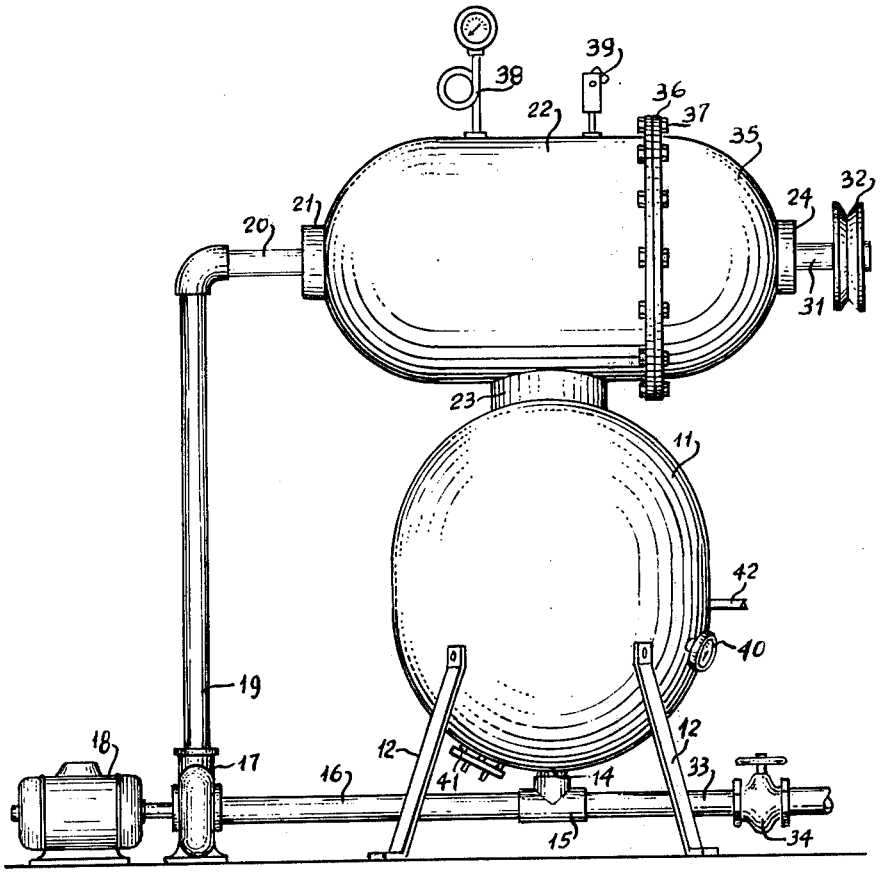
FIG. 1 is a view in vertical elevation which shows the preferred embodiment of the invention.
Figure 2:
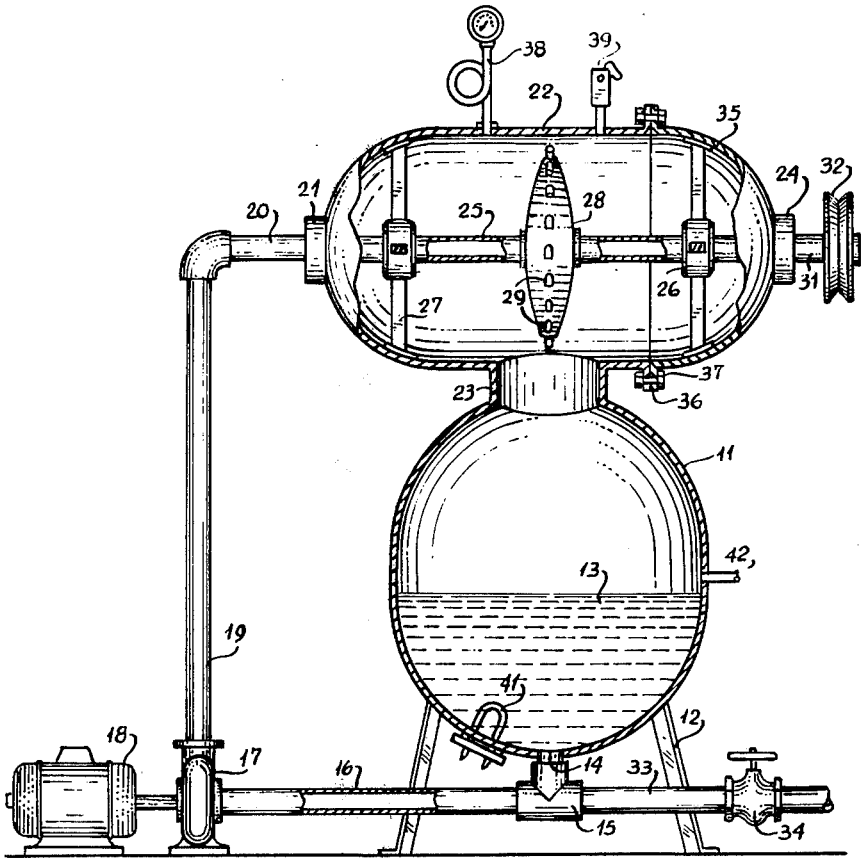
FIG. 2 is a view illustrating in conventional lengthwise section the embodiment of the invention shown in FIG. 1.

Referring now to the drawings, the thermal engine powered by the discharge from a reaction turbine to operate in an environment of vapor in the presence of its liquid in a closed system, of the present invention, is made up of two closed containers 11 and 22 which are joined and in communication by intermediate neck 23, container 22 being placed on top of container 11, the latter lower container being supported on legs 12 or similar support structure. Container 11 has orifice 42 through which fluid agent 13 is fed which is used for operation of the engine. This fluid agent 13 is conducted through a tube 16 to a pump 17 which drives liquid 13 through other tubes 19 and 20 to a hollow shaft 25 which serves as the support for a turbine 28 having an ovoid hollow configuration which functions as flywheel and distributor for the fluid, turbine 28 being inside upper container 22, in the presence of vapor with pressure and temperature maintaining the appropriate proportions for operation. Shaft 25 of turbine 28 is mounted in rotary bearings 26 supported by brackets or frames 27 secured to the inside of upper container 22, permitting the removal and insertion of hollow shaft 25 of turbine 28; at the ends of upper container 22 are packing glands or seals 21 and 24, which do not permit the escape of vapor to the outside but do allow rotation of shaft 25 which extends out through the packing gland or seal 24 in the end thereof and provides a power take-off 31, to which by means of a pulley 32 or gear or the like a speed reducer can be connected, or any other means for transmitting the power for suitable application.

Upper container 22 may include a portion thereof 35 removably attached with flanges 36 and screws 37 to permit the installation and maintenance of mechanisms appropriate for the turbine and all its parts. The turbine includes connected to the periphery thereof a plurality of elbows 29 having at their ends nozzles 30 to produce the reaction of the turbine by the discharge of liquid therethrough.

The engine may also include safety valves 39, thermometers 40, manometers 38 and other required measuring apparatus, as well as a source of electrothermal energy 41 connected to lower container 11, which replaces the heat radiated through the walls of the entire apparatus or mechanical system through which the fluid agent flows; independently thereof, it can be insulated by means of covering with thermally insulating materials appropriate for reducing thermal losses. Tube 16 connected between the discharge orifice 14 of container 11 which contains the fluid agent 13 and which conducts it to pump 17 may be connected by means of a pipe coupling 15 to a length of pipe 33 to discharge the fluid agent through a valve 34 when this operation is necessary. Pump 17 is driven by motor 18.

The functioning of the thermal engine of this invention can be explained in the following manner;

Mass of liquid 13 with a temperature determined by a thermal source 41 is forced through tube 16 by pump 17 driven by electric motor 18 or by any other type of drive, through tube 19 connected to hollow shaft 25; and turbine 28, to which the hot liquid is delivered, thereupon begins its angular rotation discharging the liquid through nozzles 30; by reason of the vacuum which is produced behind the nozzles caused by the rotation of reaction turbine 28 the hot liquid fluid vaporizes in these vacuum zones; and since the vapor continuously produced cannot remain permanently therein, it must liquate as it leaves the said zones because of the pressure and because of the work done by the forces of molecular cohesion of liquid 13 which trap the said molecules of saturated vapor.

The fluid is not necessarily water in its liquid state, nor steam in its vapor state, but rather it can be any fluid which because of its molecular weight and range of temperature and pressure is the most favorable for operation.

The energy of the reaction of the turbine 28 is what can be used to produce the outside useful work by means of the power takeoff on the projection 31 of hollow rotating shaft 25 the axis of reaction turbine 28 and the kinetic energy produced by the dynamic action of the turbine is requiered to maintain the system in equilibrium at constant pressure and temperature.

Once the engine has reached its working speed, the calorific energy supplied initially can be cut off and the engine will continue to work in a self-sufficient manner, in successive cycles of changes of state originated by the constant ordered movement of the hot liquid from liquid to gas or vapor and from gas or vapor to liquid, without change of chemical composition. The dissipation of heat in the outside medium by radiation by way of the containers and external parts of the engine would give rise to a progressive reduction of the temperature and pressure of the internal system, if this loss were not compensated in the conventional manner; these heat losses can be reduced to some degree by the use of suitable thermally insulating coverings, but the excess of those radiations and losses of energy which are not self-recoverable can be compensated by supplying the inside of the system with additional heat which can be done by the automatic operation of suitable electrothermal resistances such as 41.

Notwithstanding that the foregoing description has been drawn in relation to a specific embodiment of the invention, it will be understood by all persons skilled in the subject matter that any modification in form and detail will be comprised within the spirit and scope of the present invention.

I claim:

1. A thermal engine which comprises a first closed upper container having a lower orifice; a second closed lower container having an upper orifice and an inlet for liquid and a discharge for liquid, a neck member connecting the orifices of first and second containers, thus making up a double closed container with communication through said neck, a pump means having inlet and outlet, a driving means for said pump, a tube means which connects said discharge of said lower container to said inlet of said pump means, bearing means supported on the inside of said upper container, a hollow shaft rotatably supported in said bearing means, a tube means connecting outlet of said pump to said hollow shaft, fluid-tight hermetic sealing means installed integral with wall of said first upper container, by means of which the said connection between said tube means and said hollow rotating shaft is effected, said hollow shaft being closed at the end opposite to the end connected to said tube means and extending out through the wall of said first upper container, fluid-tight sealing means integral with said wall of first upper container through which the closed end of said hollow shaft extends in sealing relationship, power transmission means connected to said closed end of said hollow shaft extending out from said first upper container, reaction turbine means connected to said hollow shaft with internal communication of the fluid therewith, discharge means from the reaction turbine which project radially and tangentially therefrom, a liquid mass introduced into said second lower container through said liquid inlet, a heat source to raise the temperature of said liquid mass; whereby said liquid mass when heated is driven by said pump through said tube means and said hollow rotary shaft to said reaction turbine, said hot liquid mass being discharged therefrom and converted into saturated vapor which is subsequently condensed, there being constant pressure and constant temperature inside said containers in presence of its liquid in the closed system.

2. Thermal engine as set forth in claim 1, wherein said means of measuring pressure and temperature are connected to said containers.

3. Thermal engine as set forth in claim 1, wherein said reaction turbine is made up of a body hollow and ovoid in form which serves as distributor and flywheel connected to said hollow tubular shaft wherein the fluid agent which feeds its operation flows.

4. Thermal engine as set forth in claim 1, wherein said discharge means of the reaction turbine comprise multiple elbows which are mounted on the periphery of said turbine and include at the ends of said elbows converging-diverging nozzles.

5. Thermal engine as set forth in claim 1, wherein said upper tank comprises a part thereof which is removable and connected by means of flanges.

6. Thermal engine as set forth in claim 1, wherein said reaction turbine effects its angular rotation and discharges the liquid through the nozzles by virtue of the vacuum produced behind the nozzles as a result of the peripheral rotation of the reaction turbine.

7. Thermal engine as set forth in claim 1, wherein said heat source for raising the temperature of said liquid mass is an elecrical resistance.

8. Thermal engine as set forth in claim 1, wherein said means of power transmission secured to the projecting end of said hollow shaft is a pulley.

9. Thermal engine as set forth in claim 1, wherein said liquation under pressure is produced by the work done by the forces of molecular cohesion of the liquid which traps the molecules of vapor.

10. Thermal engine as set forth in claim 1, wherein said liquid has a molecular weight with a range of pressure and temperature adequated for the operation of the engine.

* * * * *